US010978786B2

(12) United States Patent
Qiu

(10) Patent No.: US 10,978,786 B2
(45) Date of Patent: Apr. 13, 2021

(54) ANTENNA SYSTEM AND MOBILE TERMINAL

(71) Applicant: AAC Technologies Pte. Ltd., Singapore (SG)

(72) Inventor: Xiaojun Qiu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/525,589

(22) Filed: Jul. 30, 2019

(65) Prior Publication Data

US 2020/0052383 A1 Feb. 13, 2020

(30) Foreign Application Priority Data

Aug. 13, 2018 (CN) ..... 201810915707.3

(51) Int. Cl.
*H01Q 1/24* (2006.01)
*H01Q 5/328* (2015.01)
(Continued)

(52) U.S. Cl.
CPC ..... *H01Q 1/243* (2013.01); *H01Q 1/38* (2013.01); *H01Q 5/328* (2015.01); *H01Q 9/26* (2013.01)

(58) Field of Classification Search
CPC ..... H01Q 1/243; H01Q 9/42; H01Q 1/48; H01Q 5/328; H01Q 21/28; H01Q 1/38; H01Q 5/335; H01Q 13/10; H01Q 5/378; H01Q 1/2291; H01Q 5/371; H01Q 9/0421; H01Q 1/24; H01Q 5/35; H01Q 13/16; H01Q 1/40; H01Q 21/22; H01Q 5/30; H01Q 5/385; H01Q 5/50; H01Q 1/241;
(Continued)

(56) References Cited

U.S. PATENT DOCUMENTS

2019/0131212 A1* 5/2019 Baek ..... H01L 21/6835

FOREIGN PATENT DOCUMENTS

CN 101266037 A 9/2008
CN 102709672 A 10/2012
(Continued)

OTHER PUBLICATIONS

1st Office Action dated Nov. 18, 2019 by SIPO in related Chinese Patent Application No. 201810915707.3 (8 Pages).
(Continued)

*Primary Examiner* — Monica C King
(74) *Attorney, Agent, or Firm* — W&G Law Group LLP

(57) ABSTRACT

Provided is an antenna system applied to a mobile terminal and including a back shell having a metal frame, a main board received in the back shell, an antenna unit provided between the back shell and the main board. The main board includes a front surface facing towards the antenna unit and a back surface arranged opposite to and spaced apart from the front surface. The mobile terminal includes a first metal ground layer and a first electrode plate provided on the front surface, a second metal ground layer and a second electrode plate provided on the back surface. The first electrode plate and the second electrode plate are spaced apart from the first and second metal ground layer, and connected to the antenna unit and the metal frame. The first and second electrode plates are arranged opposite to and spaced apart from each other to form a capacitor structure.

12 Claims, 5 Drawing Sheets

(51) Int. Cl.
*H01Q 1/38* (2006.01)
*H01Q 9/26* (2006.01)

(58) Field of Classification Search
CPC ..... H01Q 1/36; H01Q 1/50; H01Q 1/521; H01Q 21/0006; H01Q 21/0025; H01Q 21/065; H01Q 21/08; H01Q 21/30; H01Q 5/364; H01Q 5/392; H01Q 5/40; H01Q 9/0414; H01Q 9/0442; H01Q 9/0457; H01Q 9/40; H01Q 13/103; H01Q 19/005; H01Q 1/06; H01Q 1/1207; H01Q 1/2258; H01Q 1/242; H01Q 1/42; H01Q 1/44; H01Q 1/46; H01Q 1/523; H01Q 21/0075; H01Q 21/061; H01Q 21/064; H01Q 21/29; H01Q 21/293; H01Q 3/24; H01Q 3/26; H01Q 3/38; H01Q 3/40; H01Q 5/10; H01Q 5/20; H01Q 5/307; H01Q 5/321; H01Q 5/342; H01Q 5/357; H01Q 7/00; H01Q 9/0407; H01Q 9/06; H01Q 9/065; H01Q 9/14
See application file for complete search history.

(56) References Cited

FOREIGN PATENT DOCUMENTS

| | | | |
|---|---|---|---|
| CN | 107394351 | A | 11/2017 |
| CN | 107634334 | A | 1/2018 |
| CN | 208655894 | U | 3/2019 |

OTHER PUBLICATIONS

International Search Report dated Jul. 23, 2019 by WIPO in related PCT Patent Application PCT/CN2019/087687 (4 Pages).

* cited by examiner

ANTENNA SYSTEM AND MOBILE TERMINAL

TECHNICAL FIELD

The present disclosure relates to the field of antenna technologies, and in particular, to an antenna system and a mobile terminal.

BACKGROUND

The fifth-generation mobile communication is drawing near, and the 5G time of China's three major operators has also been confirmed. The 5G handheld mobile terminal products are mainly divided into two categories, millimeter wave and SUB 6G. A transmission rate of the future 5G network can reach up to 10 Gbps, and it can be seen from the 5G NR released by the 3GPPRAN that new band usage demands have been planned. The mobile phone hardware supports these usage demands, so that difficulty of an antenna layout has significantly increased, which also indicates that the antenna must cooperate with the hardware to get the better communication quality and user experience in the case of high-rate transmission traffic. Although the design of an antenna is a small part, it is a very important technical point, and, how to take into account of multi-band usage and multiple CA requirements in a limited space is a big challenge in the antenna design.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
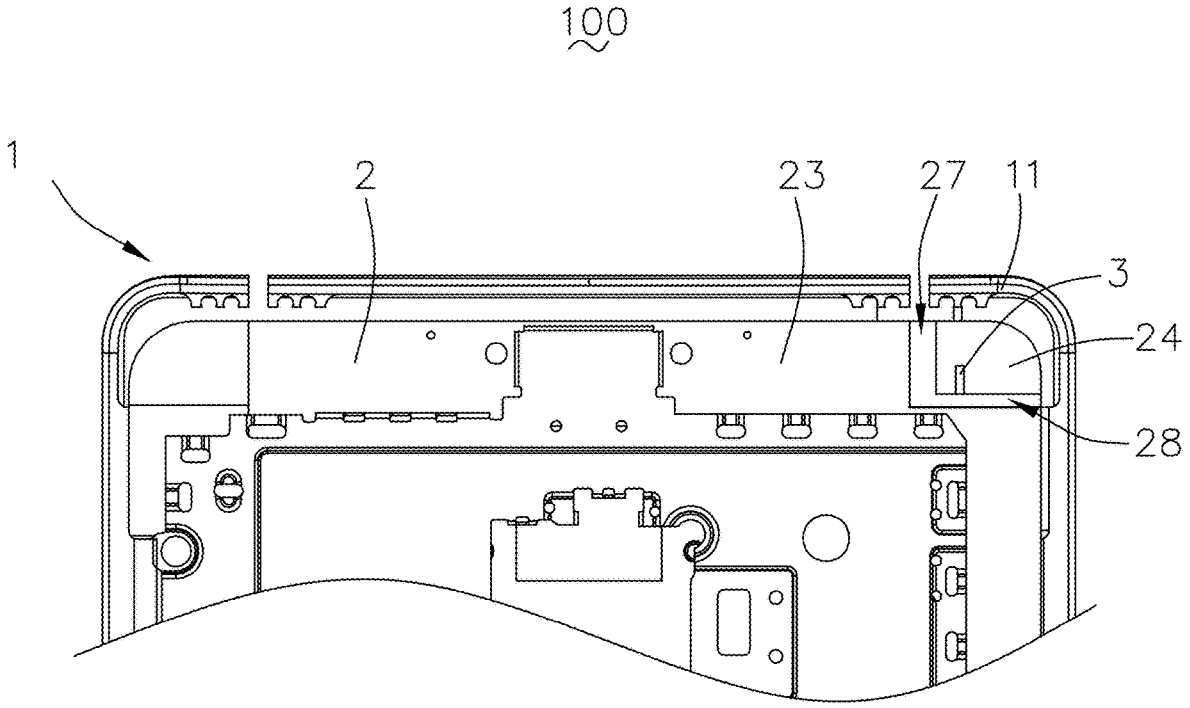
FIG. 1 is a top view of a partial structure of a mobile terminal according to the present disclosure.
Figure 2:
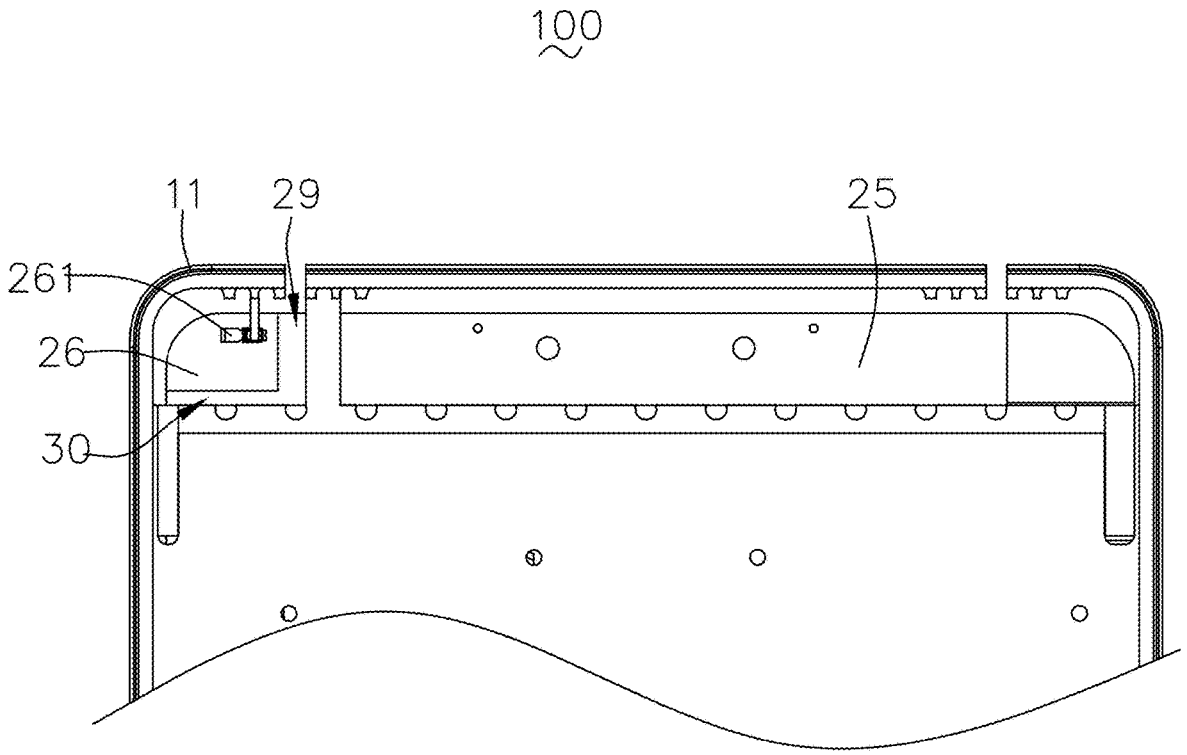
FIG. 2 is a bottom view of a partial structure of a mobile terminal according to the present disclosure.
Figure 3:
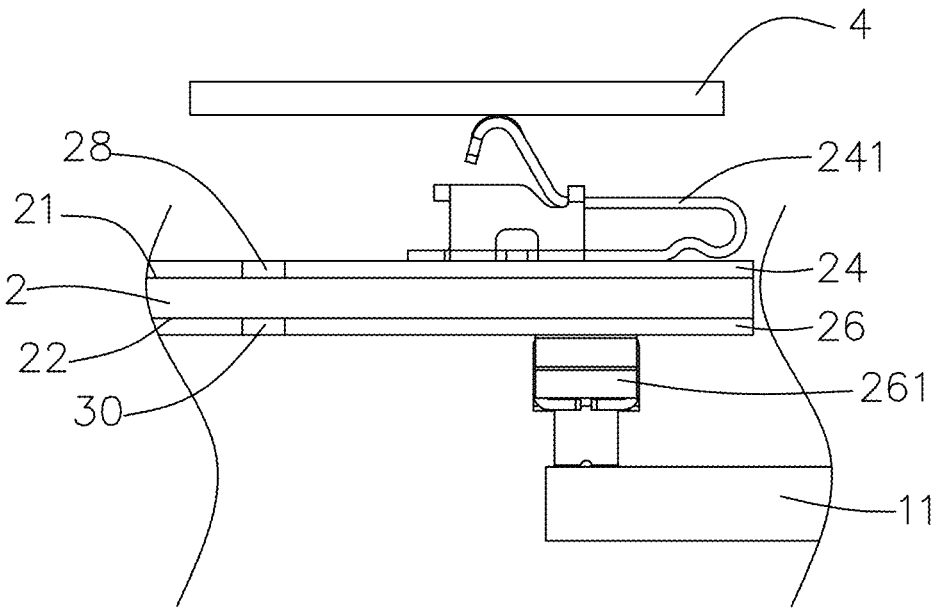
FIG. 3 is a cross-sectional diagram of part of a structure of a mobile terminal according to the present disclosure.

Referring to FIG. 1 to FIG. 3, an embodiment of the present disclosure provides an antenna system, which is applied to a mobile terminal 100. The mobile terminal 100 includes a back shell 1 having a metal frame 11, a main board 2 received in the back shell 1, a bracket disposed between the back shell 1 and the main board 2, and an antenna unit 4 provided at a surface of the bracket. Practically, the mobile terminal 100 further includes a display screen (not shown) that cooperates with the back shell 1 to form a receiving space, and other electronic components (not shown) received in the receiving space, which are not listed here.

The main board 2 includes a front surface 21 facing towards the antenna unit 4 and a back surface 22 arranged opposite to and spaced apart from the front surface 21. The main board 2 includes an antenna feeding network (not shown) connected to the antenna unit 4.

The mobile terminal 100 further includes a first metal ground layer 23 and a first electrode plate 24 that are provided on the front surface 21, and a second metal ground layer 25 and a second electrode plate 26 that are provided on the back surface 22. The first electrode plate 24 is spaced apart from the first metal ground layer 23 and connected to the antenna unit 4. Specifically, the first electrode plate 24 is connected to the antenna unit 4 by a sprung leg 241. The second electrode plate 26 is spaced apart from the second metal ground layer 25 and connected to the metal frame 11. Specifically, the second electrode plate 26 is connected to the metal frame 11 by a sprung leg 261. The first electrode plate 24 and the second electrode plate 26 are arranged opposite to and spaced apart from each other to form a capacitor structure. The magnitude of the capacitance of the capacitor structure depends on a distance between the associated first electrode plate 24 and the second electrode plate 26 and areas thereof. In a specific embodiment of the disclosure, the distance between the first electrode plate 24 and the second electrode plate 26 is 0.5-0.7 mm, preferably 0.65 mm.

A projection of the first electrode plate 24 on the back surface 22 coincides with the second electrode plate 26. In a specific embodiment of the present disclosure, the first electrode plate 24 and the second electrode plate 26 are provided at a corner position of the main board 2, specifically corresponding to a corner of the metal frame 11.

The antenna system includes a first slit 27 and a second slit 28 that respectively separate the first electrode plate 24 from the first metal ground layer 23 along a long axis direction and a short axis direction of the mobile terminal, and a third slit 29 and a fourth slit 30 that respectively separate the second electrode plate 26 from the second metal ground layer 25 along the long axis direction and the short axis direction of the mobile terminal. The first slit 27 is in communication with the second slit 28, and the third slit 29 is in communication with the fourth slit 30. An orthographic projection of the first slit 27 on the back surface 22 coincides with the third slit 29. An orthographic projection of the second slit 28 on the back surface 22 coincides with the fourth slit 30. Thus, the resonance and impedance of the antenna system can be adjusted simply by adjusting lengths and widths of the first slit 27, the second slit 28, the third slit 29, and the fourth slit 30.

The antenna system further includes a feeding point 3 provided at the first electrode plate 24, and the feeding point 3 is in communication with an external power source to achieve feeding of the antenna system. Specifically, the external power source can be connected to the feeding point through a microstrip wire.

Figure 4:
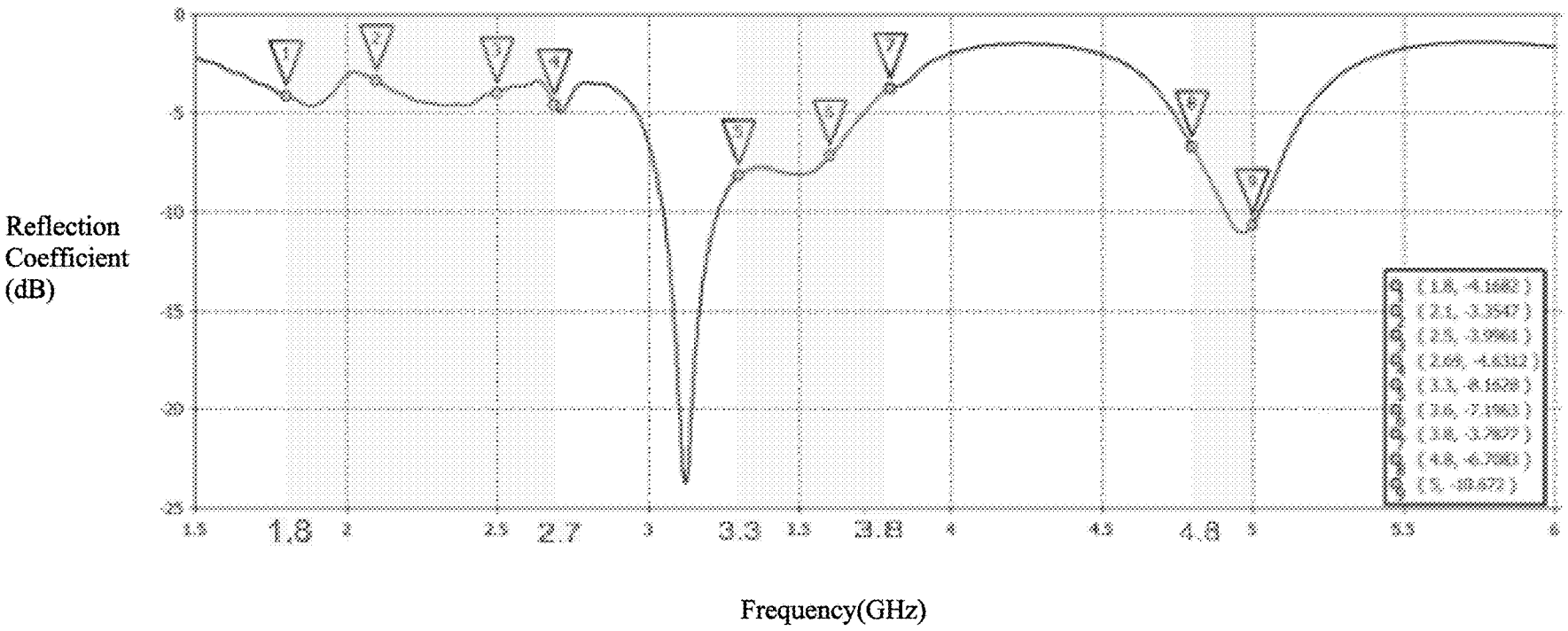
FIG. 4 illustrates a reflection coefficient graph of an antenna system according to the present disclosure.
Figure 5:
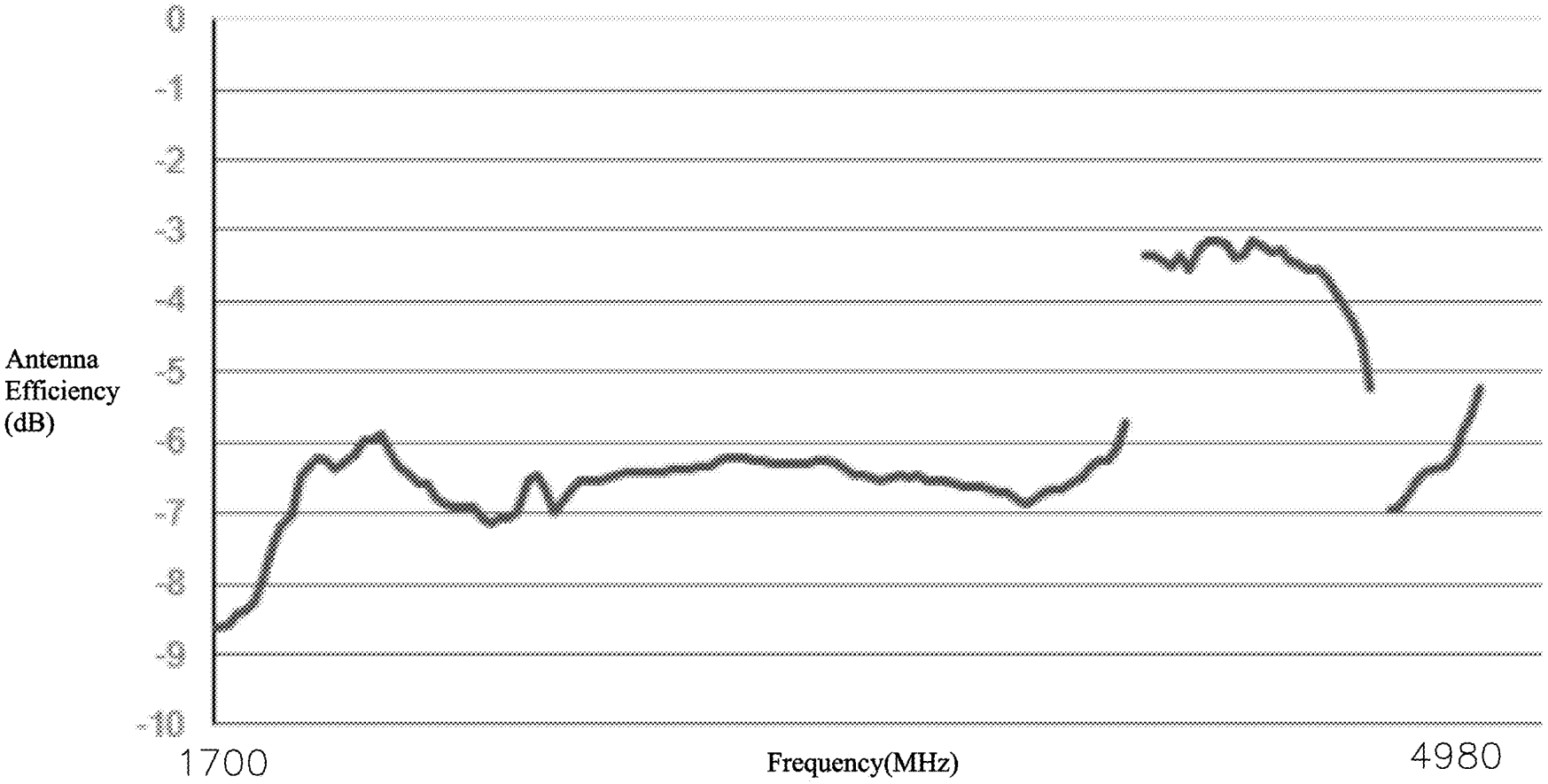
FIG. 5 illustrates an antenna efficiency graph of an antenna system according to the present disclosure.

Referring to FIG. 4, the antenna system provided by the present disclosure can operate at 1.8-2.7 GHz, 3.3-3.8 GHz, and 4.8-5 GHz. Referring to FIG. 5 in conjunction, it can be seen that, in the above band, the antenna efficiency of the antenna system is generally between −7 dB and −3 dB, which can meet actual needs. In summary, the antenna system provided by the present disclosure is capable of supporting C Band and medium frequency, medium-high frequency and high frequency of LTE in the 5G mobile communication.

Compared with the related art, the antenna system provided by the present disclosure has the following advantages.

1. Multiple resonances can be generated, and an occupying area of the antenna unit is small.

2. The bandwidth is wider, and capable of supporting C Band and medium frequency, medium-high frequency and high frequency of LTE in the 5G mobile communication.

3. In the case of a small occupying area, the antenna performance is better than that of the conventional structure.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. An antenna system applied to a mobile terminal, the mobile terminal comprising:

a back shell having a metal frame;

a main board received in the back shell; and an antenna unit provided between the back shell and the main board, wherein the main board comprises a front surface facing right towards the antenna unit and a back surface arranged opposite to and spaced apart from the front surface, the mobile terminal further comprises a first metal ground layer and a first electrode plate that are provided on the front surface, and a second metal ground layer and a second electrode plate that are provided on the back surface, the first electrode plate is spaced apart from the first metal ground layer and connected to the antenna unit, the second electrode plate is spaced apart from the second metal ground layer and connected to the metal frame, the first electrode plate and the second electrode plate are arranged opposite to and spaced apart from each other to form a capacitor structure, and the first electrode plate is provided with a feeding point that communicates with an external power source; wherein the first electrode plate and the second electrode plate are provided at a corner position of the main board; the antenna system comprises a first slit and a second slit that respectively separate the first electrode plate from the first metal ground layer along a long axis direction and a short axis direction of the mobile terminal, and a third slit and a fourth slit that respectively separate the second electrode plate from the second metal ground layer along the long axis direction and the short axis direction of the mobile terminal, the first slit being in communication with the second slit, and the third slit being in communication with the fourth slit.

2. The antenna system as described in claim 1, wherein an orthographic projection of the first electrode plate on the back surface coincides with the second electrode plate.

3. The antenna system as described in claim 1, wherein a distance between the first electrode plate and the second electrode plate is 0.5-0.7 mm.

4. The antenna system as described in claim 1, wherein an orthographic projection of the first slit on the back surface coincides with the third slit, and an orthographic projection of the second slit on the back surface coincides with the fourth slit.

5. The antenna system as described in claim 1, wherein the first electrode plate is connected to the antenna unit by a sprung leg.

6. The antenna system as described in claim 1, wherein the second electrode plate is connected to the metal frame by a sprung leg.

7. A mobile terminal, comprising the antenna system as described in claim 1.

8. The mobile terminal as described in claim 7, wherein an orthographic projection of the first electrode plate on the back surface coincides with the second electrode plate.

9. The mobile terminal as described in claim 7, wherein a distance between the first electrode plate and the second electrode plate is 0.5-0.7 mm.

10. The mobile terminal as described in claim 7, wherein an orthographic projection of the first slit on the back surface coincides with the third slit, and an orthographic projection of the second slit on the back surface coincides with the fourth slit.

11. The mobile terminal as described in claim 7, wherein the first electrode plate is connected to the antenna unit by a sprung leg.

12. The mobile terminal as described in claim 7, wherein the second electrode plate is connected to the metal frame by a sprung leg.

* * * * *